United States Patent [19]

Bach et al.

[11] Patent Number: 4,601,949

[45] Date of Patent: Jul. 22, 1986

[54] CONJUGATE FILAMENTS AND PROCESS FOR PRODUCING SAME

[75] Inventors: Hartwig C. Bach; William B. Black, both of Pensacola, Fla.

[73] Assignee: Monsanto Company, St. Louis, Mo.

[21] Appl. No.: 670,241

[22] Filed: Nov. 13, 1984

Related U.S. Application Data

[63] Continuation-in-part of Ser. No. 484,110, Apr. 11, 1983, abandoned.

[51] Int. Cl.[4] ..... D02G 3/00

[52] U.S. Cl. ..... 428/374; 428/370; 428/371; 428/373; 428/364

[58] Field of Search ..... 428/370, 371, 373, 374, 428/364; 264/171

[56] References Cited

U.S. PATENT DOCUMENTS

| | | | |
|---|---|---|---|
| 2,931,091 | 4/1960 | Breen | 28/82 |
| 2,987,797 | 6/1961 | Breen | 28/82 |
| 3,399,108 | 8/1968 | Olson . | |
| 3,408,277 | 10/1968 | Martin | 264/168 |
| 3,418,199 | 12/1978 | Anton et al. . | |
| 3,536,802 | 10/1970 | Uraya et al. | 264/171 |
| 3,558,760 | 1/1971 | Olson | 264/168 |
| 3,667,207 | 6/1972 | Ben et al. . | |
| 3,671,620 | 6/1972 | Inoue | 264/171 |
| 3,675,408 | 7/1972 | Pacini et al. | 428/371 |
| 3,779,853 | 12/1973 | Olson . | |
| 4,019,311 | 4/1977 | Schippers . | |
| 4,069,363 | 1/1978 | Segraves | 428/370 |
| 4,202,854 | 5/1980 | Howse et al. | 264/168 |
| 4,244,907 | 1/1981 | Wu | 264/168 |
| 4,271,233 | 6/1981 | Plischke et al. | 428/370 |

FOREIGN PATENT DOCUMENTS

| | | |
|---|---|---|
| 0019622 | 8/1968 | Japan . |
| 0148718 | 7/1973 | Japan . |

*Primary Examiner*—Lorraine T. Kendell

*Attorney, Agent, or Firm*—John W. Whisler

[57] ABSTRACT

Polyamide conjugate filaments are prepared by a spin-stretch process wherein two polyamides (e.g. two nylon 66 polymers) having different terminal velocity distances are melt spun at a spinning speed of at least 1829 mpm to form filaments in which the polymers are arranged in an eccentric configuration along the length of the filaments. The filaments are then stretched in-line at a stretch ratio greater than 1.0 prior to their being collected with the processing conditions and polyamides being selected to provide filaments having a high level of high-load crimp and a low level of boiling water shrinkage. The filaments are particularly useful in the construction of stretch garments and, especially, ladies' leg hose and pantyhose.

18 Claims, 2 Drawing Figures

CONJUGATE FILAMENTS AND PROCESS FOR PRODUCING SAME

BACKGROUND OF THE INVENTION

CROSS-REFERENCE TO RELATED APPLICATIONS

This application is a continuation-in-part of copending application Ser. No. 484,110, filed Apr. 11, 1983 now abandoned.

A. Field of the Invention

This invention relates to novel polyamide conjugate filaments having a high level of "high-load" crimp and to a novel process for producing such filaments.

The term "conjugate filament" means a filament comprising a first longitudinal polymeric segment and a second longitudinal polymeric segment arranged in an eccentric configuration along the length of the filament and differing from each other in longitudinal dimensional change characteristics. The term "eccentric" as used herein includes both side-by-side and asymmetrical sheath-core structures. By differing in "longitudinal dimensional change characteristics" is meant that when the filament is structurally relaxed, as evidenced by the filament assuming a helical configuration. The formation of helical crimp in the foregoing test, of course, confirms the presence of at least two eccentrically arranged segments as well as their differing dimensional change characteristics. Conjugate filaments having segments differing from each other in longitudinal dimensional change characteristics can be produced by methods well known in the art, such as, by using polymers having different relative viscosities (e.g. see U.S. Pat. No. 3,536,802). There may be a distinct line of demarcation between the segments at their interface or, in some instances, merely a gradient change in composition of the filament across its cross-section.

The term "high-load crimp" as used herein means crimp (e.g., helical coils) being developed and/or retained during performance of the high-load crimp test hereafter defined. The term "low-load crimp" means crimp developed and/or retained during performance of the low-load crimp test hereinafter defined.

B. Description of the Prior Art

Conjugate filaments and their preparation are well known in the art. Typically, their preparation comprises two completely separate and discontinuous operations; a melt spinning operation in which two different polymers are co-extruded to form as-spun filaments which are wound onto a bobbin to form a package, and a stretching operation in which the as-spun filaments are withdrawn from the bobbin, stretched and then wound onto a second bobbin to once again form a package. The polymers may differ from one another with respect to, for example, their chemical structure (e.g., see U.S. Pat. Nos. 3,399,108, 3,418,119 and 4,019,311) or the polymers may have the same structure and be different because of a difference in relative viscosity (e.g., see U.S. Pat. No. 3,536,802) or because one polymer contains an additive that changes its morphology and the other polymer does not (e.g., see U.S. Pat. No. 4,271,233). U.S. Pat. Nos. 4,244,907 and 4,202,854 describe a process for producing conjugate filaments wherein, instead of co-extruding two polymers, a single polymer is extruded to form a monocomponent molten stream that is treated, such as by subjecting the stream to one-sided cooling before it is completely solidified (e.g., see U.S. Pat. No. 4,244,907) or to one-sided heating immediately after it is solidified (e.g., see U.S. Pat. No. 4,202,854). In these instances the filament is stretched immediately after the one-sided treatment.

Prior art polyamide conjugate filaments are lacking in one or more respects, for example, such filaments lack the ability, when subjected to mild conditions, to develop an adequate level of crimp having characteristics of the type required of filaments used in the construction of "stretch" garments, such as leg hose, panty hose, athletic wear, leotards, etc.

By "mild conditions" is meant conditions no more drastic than those encountered in the conventional atmospheric pressure dyeing process used commercially to dye leg hose and include the conditions encountered in the performance of the high-load crimp test, dye bath crimp test or cold water crimp test, each test of which is hereinafter defined.

SUMMARY OF THE INVENTION

The present invention provides polyamide conjugate filaments having the ability, when subjected to mild conditions, to develop crimp having characteristics of the type required of filaments useful in the construction of strength garments. More specifically, the invention provides polyamide conjugate filaments having a high-load crimp test value (CRIMP) of at least 12% and, preferably, also having a boiling water shrinkage test value (BWS) such that CRIMP/BWS is at least 1.0. In its simplest form the filaments consist essentially of two such segments, each consisting essentially of nylon 66 or nylon 6.

In its broadest aspect the process of the invention comprises stretching a fresh filament at a stretch ratio greater than 1.0 and less than that which would cause the filament to break, said filament being melt spun at a spinning speed of at least 1829 mpm (meters per minute) and comprising a first longitudinal polyamide segment and a second longitudinal polyamide segment arranged in an eccentric configuration along the length of the filament and differing from each other in dimensional change characteristics, said difference and said stretch ratio being selected to provide a filament having a high-load crimp test value of at least 12% and a boiling water shrinkage test value such that the quotient obtained by dividing said crimp test value by said boiling water shrinkage test value (i.e. CRIMP/BWS) is at least 1.0. By "fresh" filament is meant a filament which has not been allowed to age under conditions such that when stretched no substantial improvement is obtained as compared to characteristics obtained when a filament spun under the same conditions is aged for four (4) hours at 70% relative humidity and at a temperature of 25° C. prior to stretching to the same stretch ratio. Fresh filament characteristics can, in some instances, be preserved at least temporarily by collecting and maintaining the filament under anhydrous conditions until it is drawn as shown, for example, in Example 12 herein. Although applicants do not wish to be limited by theory, the use of a fresh filament is believed to provide desirable results due to crystalline characteristics at the time of stretching.

According to a preferred embodiment of the invention, the process is a spin-stretch process wherein the stretching of the filament is accomplished in-line during melt spinning after the filament is formed and before it is collected.

According to the preferred embodiment of the invention, the process is a spin-stretch process comprising co-extruding two molten fiber-forming polyamides having different terminal velocity distances to form a molten stream in which the polyamides are arranged in an eccentric configuration along the length thereof, cooling and solidifying said molten stream in a quenching zone to form a filament (solidified molten stream), attenuating and accelerating said molten stream by withdrawing the filament from the quenching zone at a speed (i.e., spinning speed) of at least 1829 mpm and then stretching the filament at a stretch ratio greater than 1.0 in-line before it is collected and, preferably, as soon as possible after the molten stream has solidified, the processing conditions and polyamides being selected to provide a filament having a high-load crimp test value of at least 12% and a boiling water shrinkage test value such that CRIMP/BWS is at least 1.0. As used herein, the term "solidified" means the molten stream has cooled sufficiently so that it no longer sticks (i.e. fuses) to other filaments or to yarn guide surfaces. Polyamides having "different terminal velocity distances" are characterized in that under the particular spin-stretch conditions employed to form the molten stream the polyamides solidify at different distances from their point of extrusion (i.e., at different distances from the spinneret). The measurement of terminal velocity distances is hereinafter described.

In general, the highest high-load crimp test values and lowest boiling water shrinkage test values are attained by selecting highly crystalline homopolyamides, such as nylon 66 and to a lesser extent nylon 6. Preferably, both homopolyamides are of the same chemical structure, that is, consist of recurring structural units of the same chemial formula. Most preferably each polyamide is a nylon 66.

The polyamide conjugate filaments of the present invention have little or no torque (i.e., are substantially torque-free) and, therefore, offer certain advantages over false-twist textured filaments which contain substantial torque (i.e., are torque-lively). One advantage is that conjugate filaments may be used in the form of a mid-denier singles yarn (e.g. 140 denier/34 filament yarn), whereas friction false-twisted filaments cannot normally be used in this form because of torque, but rather are used in the form of a plied yarn where two 70 denier singles yarns of opposite torque are plied to form a 140 denier yarn of balanced torque.

The polyamide conjugate filaments of the present invention have a high-load crimp test value of at least 12%. In general, the higher the high-load crimp test value the more suitable the filament is for stretch garment applications. For hosiery, the test value should be at least 15% and, preferably, at least 18%. Conjugate filaments of the present invention, when subjected to mild conditions develop adequate crimp having characteristics of the type required for stretch garments, whereas prior art filaments require much more drastic conditions to develop such crimp, e.g., exposure to superheated steam.

According to one embodiment of the invention polyamide conjugate filaments are provided which have a high-load crimp test value of at least 12%, a dye bath shrinkage test value (DBS) such that CRIMP/DBS is at least 2.0, but do not have a CRIMP/BWS of at least 1.0. Nevertheless, such filaments are of interest since they have the ability when dyed using the conventional atmospheric pressure dyeing process to develop an acceptable level of crimp having characteristics of the type required of filaments used for the construction of stretch garments and yet their shrinkage under such conditions (DBS) is acceptable for stretch garment applications.

According to another embodiment of the invention, the spin-stretch process is used to provide polyamide conjugate filaments which, although not having the ability to develop sufficient high-load crimp for hoisery applications, nevertheless, have the ability to develop sufficient low-load crimp for other stretch garment applications. According to this embodiment of the invention, the polyamides and processing conditions of the spin-stretch process are selected to provide filaments having a low-load crimp test value of at least 40% and, preferably, at least 50%.

DETAILED DESCRIPTION OF THE PREFERRED EMBODIMENTS OF THE INVENTION

The presence of the present invention provides conjugate filaments having improved properties. For example, the process of the invention can be utilized to provide polyamide conjugate filaments which are particularly useful for ladies' leg hose applications. While the process of this invention may be used to prepare a conjugate filament composed of three or more fiber-forming polymeric segments, the two-segment filament is preferred since it offers economic advantages over other multi-segment filaments; as the number of segments increases, the process becomes more and more complicated and less and less practical. Accordingly, the invention is described herein with reference to the two-segment conjugate filament.

Figure 1:
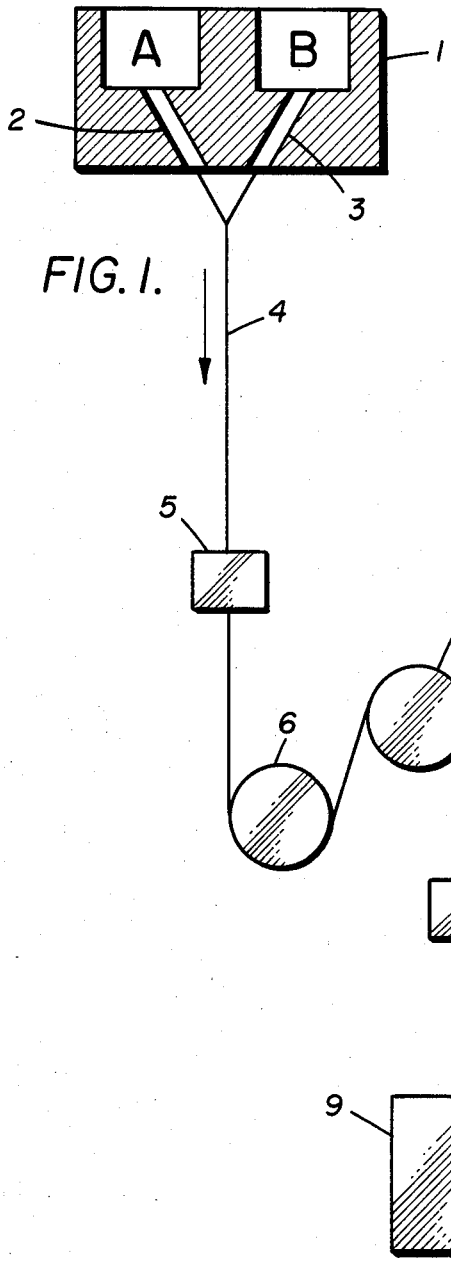
FIG. 1 is a schematic representation of equipment useful in practicing the spin-stretch process of the present invention.

In a preferred embodiment of the invention, the process is carried out using the equipment arrangement shown in FIG. 1. Referring to FIG. 1, polyamides A and B of different terminal velocity distances are coextruded at about the same melt temperature at a given speed (extrusion speed) in molten form through circular capillaries 2 and 3, respectively, of spinneret 1. The molten polymers converge below the spinneret face to form molten stream 4 in which polyamides A and B are arranged, as segments, in a side-by-side configuration. For purposes of illustration the formation of only one filament is shown in FIG. 1. It will be understood, however, in actual practice of the invention the spinneret will normally have provisions for forming a plurality of molten streams; that is, the spinneret will have a plurality of capillary pairs 2 and 3. Molten stream 4 is then quenched by conventional means to form a filament (i.e., solidified molten stream). The filament is then passed into contact with finish applicator means 5 which applies a liquid finish to the filament. Where there is a plurality of filaments, the filaments are conveniently converged on applicator means 5. The filament is then passed around feed roll 6 with a partial wrap, around stretch roll 7 with a partial wrap, heated by heating means 8 (e.g., a heated tube through which the filament passes) and finally collected by collecting means 9 (e.g., a bobbin on which the filament is wound). Roll 6 is rotated at a peripheral speed of at least 1829 mpm. Roll 7 is rotated at a peripheral speed greater than that of roll 6 but usually no greater than twice that of roll 6. The partial wraps are of an angle sufficient to prevent slippage of the filament on the rolls. When the filament is collected on a bobbin, it should be collected at a speed less than the peripheral speed of roll 7, thereby permitting the filament to relax (retract) before it is collected; otherwise, difficulty is encountered in removing the bobbin from the chuck on which it is rotated, particularly, where the filament or yarn makes a large number of wraps on the bobbin to form the package. In instances where the filament makes only a small number of wraps on the bobbin, heating of the filament by means 8 may be omitted. The filament collected on the bobbin normally has both original crimp (visible crimp) which manifests itself when the spinning tension is released and latent crimp which can be developed by subsequent treatment of the yarn.

Figure 2:
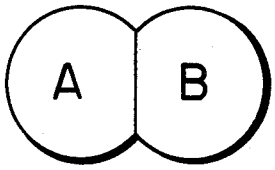
FIG. 2 is a representation of the cross-section of a conjugate filament prepared by the spin-stretch process of the invention.

FIG. 2 shows the cross-section of a typical conjugate filament prepared in accordance with the process of the invention wherein the ratio of segment A to segment B used in forming the filament is 1:1.

In accordance with the preferred embodiment of the invention, the spin-stretch process is carried out under processing conditions and using polyamides so as to provide a filament having a high-load crimp test value of at least 15% and a CRIMP/BWS ratio value of at least 2 and most preferably values of at least 20% and 3, respectively. The following discussion considers the effect of changing the indicated processing variable while leaving all other variables constant.

One segment of the conjugate filament is preferably formed from a rapidly crystallizable fiber-forming polyamide and the other from a less rapidly crystallizable fiber-forming polyamide. This difference in crystallizability may be achieved by selecting polyamides having different terminal velocity distances. In general as the difference between their terminal velocity distances increases, the high-load crimp test value increases to or approaches a maximum value and thereafter remains substantially the same. In general, polymers become less crystallizable as the ratio of homopolymeric segments to copolymeric segments increases, for example, the crystallizability of nylon 66>nylon 66-6 (95:5)>nylon 66-6 (90:10)>nylon 66-6 (85:15). Therefore, highly crystalline homopolyamides such as nylon 66 and nylon 6 are preferred, with nylon 66 giving the highest high-load crimp test values and, therefore, being the preferred polyamide for use in practicing the invention. Nylon copolymers are designated herein in a conventional manner, for example, "nylon 66-6" means the copolymer consisting of randomly occurring 66 units, $-NH(CH_2)_6NHCO(CH_2)_4CO-$, and 6 units, $-NH(CH_2)_5CO-$, formed, for example, by copolymerizing hexamethylene diammonium adipate and caprolactam. Mole ratios when given are given in parenthesis following the copolymer designation, for example, (95:5) means a mole ratio of 95:5, respectively.

When the polyamide used to form one of the segments of the conjugate filament is composed of structural repeating units of the same chemical formula as the polyamide used to form the other segment, selection of polyamides differing from each other in relative viscosity values will provide the desired result in this process. When nylon 66 polyamides of different relative viscosities (RV) are used to form the segments, the difference in RV between the two nylon 66's should be at least 5, preferably at least 15 and most preferably at least 30 with the RV of the low RV nylon 66 being at least 20 and, preferably, at least 50 and most preferably at least 65.

While nylon 66 is the preferred polyamide, other polyamides may be used in practicing the invention. Examples of other suitable homopolyamides include nylon 6 and nylon 610. Examples of suitable copoly amides include, but are not limited to, those described in U.S. Pat. Nos. 3,399,108, 3,418,199, 3,558,760 and 3,667,207. Examples of such copolyamides are: nylon 6-66, nylon 66-610; nylon 66-610-611-612; nylon 66-612; nylon 66-6I, where 6I is

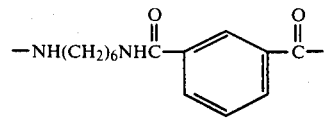

units; nylon 66-6T, where 6T is

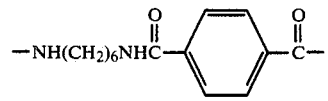

units; nylon 66-6-612; nylon 6-66-610 and nylon 6-612.

The spinneret may be designed so that in forming a molten stream each of the molten polymers may be extruded through a separate capillary in such a manner that the molten polymers converge at the spinneret face to form the molten stream or the polymers may be combined and then extruded through a common spinneret capillary to form the molten stream. However, it is preferred that each of the molten polymers be extruded through a separate capillary and converge below the spinneret face to form the molten stream as shown in FIG. 1. Unless the molten polymers converge at or below the face of the spinneret, the one segment (e.g. the low RV segment) tends to wrap around the other segment (e.g. high RV segment), which in turn tends to reduce the ultimate crimp of the filament.

The filament may be of any desired cross-section, e.g., circular, trilobal, etc. However, it is more economical to manufacture spinnerets having circular capillaries. Filaments having a cross-section resulting from the use of capillaries which are circular in cross-section are shown in FIG. 2.

The volume ratio of the polyamide segments can vary over a wide range. As a practical matter, the segment system normally will be within the range of 3:1 to 1:3. In the case where both segments are nylon 66, a ratio of 1:1 to 1:3 (high to low relative viscosity) is preferred with the greatest amount of crimp being obtained with a ratio of about 30:70 (high to low relative viscosity).

Cooling of the molten streams normally occurs in a quench chamber, commonly referred to as a chimney. The term "quench" as used herein means the cooling of the molten streams sufficiently to provide solidified streams (i.e., filaments). Although cooling of the streams may be assisted by a transverse (or concurrent) stream of flowing air, such a stream is not required in order to provide filaments having high levels of high-load crimp.

In conventional processes, the filaments are passed from the quenching chamber through what is called a "steam conditioning" tube. Steam is circulated through the tube and comes into intimate contact with the filaments. The purpose of the steam is to facilitate subsequent processing of the filament. It has been found, however, that the use of conditioning steam with the spin-stretch process of this invention significantly reduces high-load crimp, i.e., to a level substantially below 10%. Accordingly, conditioning steam should not be used with the process when high-load crimp is desired or, if it is used, it should be used very sparingly.

Finish (aqueous or anhydrous) may be applied to the filaments by conventional means, for example, by passing the filaments over a roll which transfers finish on to the filaments from a reservoir in which the roll is partially submerged and rotating. Alternatively, a stationary V-shaped guide may be used. The guide is arranged so that filaments ride in the V and a finish is metered to the filaments via a small tube. A finish is not necessary in order to obtain the desired filament properties. However, if a finish is not used, the filaments become statically charged and difficult to handle, for example, when unwinding them from a bobbin. As a practical matter, the finish is preferably an aqueous finish (water per se or a water base finish) in view of the environmental considerations involved in the use of non-aqueous finishes.

The filaments are conveniently converged on the finish applicator means (e.g. the above mentioned finish guide). If desired, the filament may be converged by means of a conventional convergence guide after being quenched and prior to a finish being applied thereto.

The molten streams are attenuated and accelerated from the spinneret (or, when formed below the spinneret, from their point of formation) by a feed roll which withdraws the quenched streams (filaments) from the quenching zone at a spinning speed greater than the extrusion speed. The extrusion speed is the linear speed at which the molten polyamide is theoretically traveling through the spinneret capillary or capillaries and is calculated from the dimensions of the capillary, the extrusion rate and the density of the polyamide. When more than one capillary is used to form the filament, the linear speeds are averaged and the average speed is used as the extrusion speed. The term "jet attenuation" (JA) as used herein represents the quotient obtained by dividing the spinning speed (SS) by the extrusion speed (ES). It has been found that increasing jet attenuation has little effect on the high-load crimp. In general, in order to obtain filaments having a high level of high-load crimp, the spinning speed must be at least 1829 mpm. Preferably, spinning speeds of at least 2286 mpm and most preferably at least 2743 mpm are used in practicing the process of the invention. In general, increasing the spinning speed and other processing speeds accordingly improves the economics of the process.

In accordance with a preferred embodiment of the present invention, the filaments are stretched in-line before being collected, for example, before being wound onto a bobbin. Normally, if the filaments are collected and then subsequently stretched in a separate operation, the filaments will not possess a significant level of high-load crimp even though they may possess a moderate level of low-load crimp. It has been discovered however, that if the filaments are spun and collected under anhydrous conditions and kept under anhydrous conditions for a limited period of time until subsequently stretched, it is possible to obtain filaments having a high-load crimp level in excess of 8% even though the stretching of the filaments is accomplished in an operation subsequent to and separate from the spinning operation. However, such conditions are usually not practical from the standpoint of commercial operations.

The stretching is preferably accomplished using a roll arrangement as shown in FIG. 1 wherein roll 6 is a feed roll and roll 7 is a stretch roll. The stretch roll is operated at a peripheral speed higher than the peripheral speed of the feed roll. With the roll arrangement shown in FIG. 1 the filaments are stretched as they leave feed roll 6. In general, as the stretch ratio is increased from 1, the level of highload crimp imparted to the filaments increases through a maximum level and thereafter decreases slightly. Normally, maximum high-load crimp test values are attained when the filaments are stretched at a ratio greater than 1.0. In many instances use of a stretch ratio greater than 2.0 can not be used without breaking filaments. It is contemplated that, if desired, the stretching of the filaments may occur downstream of the feed roll; for example, between two pairs of rolls where the first pair is rotating at the same peripheral speed as that of the feed roll and the second pair at a higher peripheral speed. Preferably, the filaments are stretched as soon as possible after being quenched. As a practical matter, at spinning speeds of at least 1829 mpm the stretching will occur within a fraction of a second after quenching. However, as mentioned above, the stretching can be delayed for long periods of time (i.e., minutes, even hours), providing the filaments are kept under anhydrous conditions. Under such conditions an anhydrous finish or no finish at all must be used. Accordingly, where the filaments are lagged for a substantial period of time (in excess of 4 seconds) before being stretched, such as in a stuffer box type tower or by means of a roller around which the filaments make a plurality of passes, an anhydrous finish is preferably used to be certain the level of high-load crimp is not significantly reduced. Where the period of time between quenching and stretching is significantly greater than about 4 seconds, the filaments may also need to be kept in an anhydrous environment. Whether or not an anhydrous finish and/or anhydrous environment provide satisfactory results can easily be determined experimentally. Where the filaments are stretched within a few seconds after quench the use of an aqueous finish and ambient conditions has very little, if any, effect on the high-load crimp level obtained by the process.

In commercial practice of the process, it will normally be desirable to wind the filaments onto a bobbin by means of a winder with the winder being operated at the lowest speed that can be used and still provide sufficient tension on the yarn to obtain an acceptable package on the bobbin. Normally, a yarn tension between 0.05 and 0.1 grams per denier is used. Generally, the difference between the peripheral speed of the stretch roll and the winder is in the range of 2 to 12%. This difference in speeds causes the yarn to relax between the stretch roll and winder. Conventional winders are available and may be used in practicing the process, which permit yarn tensions to be preset, whereby the speed of the winder automatically adjusts to maintain the preset tension. In certain instances it may be desirable to heat the yarn as it is relaxing, depending on factors such as total yarn denier, package size, processing speeds and the like. The heating of the yarn may be accomplished by exposing the yarn to radiant heat or by passing the filaments through a tube heated with air. It is also contemplated that the yarn may be heated by maintaining the stretch roll at a suitable temperature to heat the filaments. The yarn, of course, should not be heated in a manner or to a temperature that would significantly reduce its crimp. In this regard it has been found that the use of steam to heat the yarn tends to significantly reduce the high-load crimp level. Therefore, the use of steam to effect the heat relaxation of the filaments is not recommended where high levels of high-load crimp are desired.

MEASUREMENTS

A. Relative viscosity (RV) values, when given herein, are given without units. First, the intrinsic viscosity [n] of the polymer is determined and then the relative viscosity (RV) is calculated from the equation:

$$[n] = (0.184)(RV)0.491\text{: solving for } RV\text{:}$$
$$RV = e \text{ raised to the following power:}$$

$$\ln \frac{[n]}{0.184} + 0.491$$

The intrinsic viscosity is determined from the equation:

$$[n] = \lim_{c \to 0} \ln t/t_c \div C$$

where $t_o$ is the flow time at 25° C. through a viscometer of 90% formic acid (pure solvent) and t is the flow time through the same viscometer of a solution of the polymer having the concentration (c) in grams of polymer/100 ml of pure solvent. In determing the [n] of the high RV polymer a concentration of 0.25 grams/100 ml is used; in determining the [n] of the low RV polymer a concentration of 0.50 grams/100 ml is used.

B. High-load crimp and high-load shrinkage test values, when given herein, are given in terms of percent (%) and are determined on a sample of filament(s) prior to development of its latent crimp, as follows:

(1) Determine the denier of the sample
(2) Calculate the number of revolutions on a denier reel that would be required to make a skein (a continuous bundle of filaments in the form of a collapsed coil) having a denier of 4000.

$$\text{No. of Revolutions} = \frac{4000}{\text{Denier of sample}}$$

(3) Prepare a skein having a denier of 4000 from the sample.
(4) Vertically hang the skein from a stationary hook by placing the skein over the hook being careful to avoid stretching or tangling of the skein. Hook a low weight wire hook (reshaped paper clip) through the bottom of the skein.
(5) With the skein hanging vertically from the hook, suspend a 800 g weight from the wire hook (the skein now has the appearance of a single 8000 denier strand).
(6) After the weight has been suspended for 0.5 minutes, measure the length to the nearest 0.1 cm. Record this length as $L_i$ (initial length). Remove the 800 g weight and replace it with a 20 g weight.
(7) Suspend the skein with the 20 g weight in a 120° C. forced draft oven for 5 minutes.
(8) Remove the skein from the oven, let it cool for one minute and hang it once again over the stationary hook with the 20 g weight suspended from the skein via the wire hook.
(9) then without removing the 20 g weight, determine the length of the doubled skein to the nearest 0.1 cm. Record this length as $L_c$ (crimped length).
(10) Remove the 20 g weight and replace it with an 800 g weight; after 30 seconds determine the length of the skein to the nearest 0.1 cm. Record this length as $L_f$ (final length).
(11) Calculations:

$$\%\text{ high-load crimp} = \frac{L_f - L_c}{L_f} \times 100$$

$$\%\text{ high-load shrinkage} = \frac{L_i - L_f}{L_i} \times 100$$

C. Low-load crimp and low-load shrinkage test values, when given herein, are given in terms of percent (%) and are determined from a sample of filament(s) before development of its latent crimp, as follows:

(1) Determine the denier of the sample
(2) Calculate the number of revolutions on a denier reel that would be required to make a skein (a continuous bundle of filaments in the form of a collapsed coil) having a denier of 5412.

$$\text{No. of Revolutions} = \frac{5412}{\text{Denier of sample}}$$

(3) Prepare a skein having a denier of 5412 from the sample.
(4) Vertically hang the skein from a stationary hook by placing the skein over the hook being careful to avoid stretching or tangling of the skein. Hook a low weight wire hook (reshaped paper clip) through the bottom of the skein.
(5) With the skein hanging vertically from the stationary hook, suspend a 1000 g weight from the wire hook (the skein now has the appearance of a single 10824 denier strand), and after 0.5 minutes measure the length of the doubled skein to the nearest 0.10 cm and record this length as $L_i$. Remove the 1000 g weight.
(6) Suspend the skein in a 120° C. forced draft oven for 5 minutes.
(7) Remove the skein from the oven, let it cool for one minute, attached a 10 g weight to the skein via the wire hook and hang it once again over the stationary hook with the 10 g weight suspended from the wire hook.
(8) Then, without removing the 10 g weight, determine the length of the doubled skein to the nearest 0.1 cm. Record this length as $L_c$.
(9) Remove the 10 g weight and replace it with the 1000 g weight; after 30 seconds determine the length of the skein to the nearest 0.1 cm. Record this length
(10) Calculations:

$$\%\text{ low-load crimp} = \frac{L_f - L_c}{L_i} \times 100$$

-continued $$\% \text{ low-load shrinkage} = \frac{L_i - L_f}{L_i} \times 100$$

D. Boiling water crimp and boiling water shrinkage values, when given herein, are given in terms of percent (%) and are determined on a sample of filament(s) prior to development of its latent crimp, as follows:

(1) Determine the denier of the sample.

(2) Calculate the number of revolutions on a denier reel that would be required to make a skein having a denier of 2250.

$$\text{Revolutions} = \frac{2250}{\text{denier of sample}}$$

(3) Prepare a skein having a denier of 2250.

(4) Vertically hang the skein from a stationary hook by placing the skein over the hook being careful to avoid stretching or tangling of the skein. Hook a low weight hook (reshaped paper clip) through the bottom of the skein.

(5) With the skein hanging vertically from the stationary hook, suspend a 1500 g weight from the wire hook (the skein now has the appearance of a 4500 denier strand).

(6) After the weight has been suspended for 10 seconds, determine the length of the doubled skein to the nearest 0.1 cm and record this length as $L_i$ (initial length).

(7) Replace the 1500 g weight with a 6.1 g weight and immerse the skein in boiling water for 1 minute.

(8) Remove the skein from the bath, then remove the 6.1 g weight and permit the skein to air dry. After the skein is dry, condition at standard atmospheric conditions (72% RH) for 12 hours.

(9) Replace the 6.1 g weight and determine the length of the doubled skein to the nearest 0.1 cm. 10 seconds after attaching said 6.1 g weight. Record this length as $L_c$ (crimped length).

(10) Again suspend the 1500 g weight from the skein while the skein is hanging vertically from the stationary hook.

(11) After 10 seconds, determine the length of the doubled skein to the nearest 0.1 cm. and record this length as $L_f$ (final length).

(12) Calculations:

$$\% \text{ boiling water crimp} = \frac{L_f - L_c}{L_f} \times 100$$

$$\% \text{ boiling water shrinkage} = \frac{L_i - L_f}{L_i} \times 100$$

E. Cold water crimp and cold water shrinkage values, when given herein, are given in terms of percent (%) and are determined on a sample of filament(s) prior to development of its latent crimp using the same procedure that is used in determining boiling water crimp and boiling water shrinkage values, except in this instance in step (7) room temperature water (approximately 27° C.) was used in place of the boiling water bath.

F. Dye bath crimp and dye bath shrinkage values, when given herein, are given in terms of percent (%) and are determined on a sample of filament(s) prior to development of its latent crimp using the same procedure that is used in determining boiling water crimp and boiling water shrinkage values, except in this instance in step (7) the skein, instead of being placed in boiling water, is placed in a bath containing room temperature water (approximately 27° C.) and the temperature of the bath is gradually and uniformly raised to the boil over a period of one hour. The skein is removed from the bath one minute after the bath begins to boil. The conditions of this determination were devised to simulate commercial, atmospheric pressure dyeing conditions.

G. Terminal Velocity Distance: According to one aspect of the invention, the process is carried out by co-extruding through a spinneret two polyamides (e.g., Polyamide A and Polyamide B) having different Terminal Velocity Distances, Polyamide A and Polyamide B being joined to form a molten stream that is solidified in a quenching zone to form a filament and being attenuated and accelerated by withdrawing the filament from the quenching zone at a speed (spinning speed) of at least 1829 mpm. The velocity of a molten stream continually increases up to the point at which it solidifies at which point its velocity corresponds to the spinning speed. The Terminal Velocity Distance of Polyamide A is determined under the same conditions used when co-extruding Polyamide A and B except in this instance only Polyamide A is extruded. A Laser Doppler Velocimeter using a He—Ne laser with optics for 9 mm beam separation and 250 mm focal length and using a counter type signal processor Model 1980 built by TSI, Inc., St. Paul, Minn. (or equivalent instrument) is used to determine the point at which the molten stream consisting entirely of Polyamide A attains its maximum or terminal velocity. The distance from the spinneret to this point is measured and recorded as the Terminal Velocity Distance of Polyamide A. The Terminal Velocity Distance of Polyamide B is then determined in the same manner with the final denier of the solidified molten stream of Polyamide B being the same as that of Polyamide A. The actual Terminal Velocity Distance values are not important so long as the values are different.

The following examples are given to further illustrate the invention. In the following examples yarns are made using the same general apparatus and procedure described in Example 1. The specific conditions utilized are given in each example along with test results obtained.

EXAMPLE 1

This example illustrates the preparation of conjugate filaments of the present invention in which a high relative viscosity nylon 66 is used to form one of the segments and a lower relative viscosity nylon 66 is used to form the other segment.

A high relative viscosity nylon 66 (RV=82) and a lower melt viscosity nylon 66 (RV=41) having different terminal velocity distances are co-extruded in a side-by-side configuration in a 1:1 ratio using the apparatus arrangement shown in FIG. 1, except that instead of one pair of capillaries the spinneret has seven (7) pairs of circularly spaced holes (capillaries) each having a diameter of 20 mils (0.51 mm). The extrusion temperature is 285° C. and the extrusion rate is 0.011896 cc/sec/capillary. A convergence guide (metered finish pin) is located 91.44 cm from the face of the spinneret. The finish pin is rectangular in shape with its long axis being parallel to the threadline. The pin is grooved to receive and converge the seven filaments. Aqueous finish is metered to the groove and into contact with the converged filaments. The filaments are quenched enroute to the finish pin by means of a cross-flow (2.83 $m^3m$) of ambient air. The filaments in the form of a yarn are withdrawn from the finish pin at 2858 mpm (i.e. spinning speed) by means of a driven roll (feed roll) around which the yarn makes a partial wrap. The feed roll is 19 cm in diameter and located 6.1 m from the face of the spinneret. The yarn is withdrawn from the feed roll at 4572 mpm by means of a stretch roll around which the yarn also makes a partial wrap. The stretch roll is also 19 cm in diameter. The distance between the centers of the two rolls is 63 cm. The feed roll and stretch roll are arranged to prevent slippage of the yarn on the rolls. The yarn is withdrawn from the stretch roll and wound onto a bobbin by means of a conventional winder at a yarn tension of 1.0 g. Enroute to the bobbin from the stretch roll the yarn passes between, but not in contact with, two strip heaters (30.48 cm by 10.16 cm) placed 6.35 mm apart face-to-face and heated to about 275° C. The yarn relaxes between the stretch roll and bobbin an amount equal to the quotient obtained by dividing the difference between the peripheral speed of the stretch roll ($S_1$) and the winding speed ($S_2$) by ($S_1$), i.e.:

$$\% \text{ relaxation} = \frac{S_1 - S_2}{S_1} \times 100.$$

In this instance the hot relaxation is 0.098 or 9.8%.

A second bobbin of yarn is prepared and collected under identical conditions, except in this instance the heaters are eliminated from the process. The processing conditions used in making the two bobbins of yarn are summarized below:

| | |
|---|---|
| Spinneret capillaries (Hi/Lo) mm | 0.51/0.51 |
| Melt ratio (Hi/Lo) | 50/50 |
| Nylon types (Hi/Lo) | 66/66 |
| Nylon | |
| RV's (Hi/Lo) | 82/41 |
| RV's Differerce | 41 |
| Feed roll speed (mpm) | 2858 |
| Stretch roll speed (mpm) | 4572 |
| In-line stretch (X) | 1.6 |
| In-line relaxation, Hot/Cold | Given in Table 1 |

The effect of eliminating hot relaxation is shown in Table 1.

TABLE 1

| Item | In-Line Relax/% | High-Load Crimp % | Low-Load Crimp % | PWS % | Tenacity gpd |
|---|---|---|---|---|---|
| 1A | Hot/9.8 | 19.0 | 69 | 5.1 | 2.6 |
| 1B | Cold/7.8 | 20.9 | 71 | 6.0 | 2.7 |

The results given in Table 1 show that the use of heat in relaxation has a slight adverse effect on crimp and strength properties and a slight beneficial effect on BWS. The use of heat in relaxation can be avoided except to the extent larger packages are required.

EXAMPLE 2

This example shows that in the absence of an in-line stretch, yarns of high-load crimp are not obtainable even at high spinning speeds. Yarns are prepared as described in Example 1 using the following conditions:

| | |
|---|---|
| Spinneret capillaries (Hi/Lo) mm | 0.45/0.45 |
| Melt ratio (Hi/Lo) | 50/50 |
| Nylon types (Hi/Lo) | 66/66 |
| Nylon | |
| RV's (Hi/Lo) | 71/39 |
| RV's Differerce | 32 |
| Feed roll speed (mpm) | Given in Table 2 |
| Stretch roll speed (mpm) | " |
| In-line stetch (X) | " |
| In-line relaxation, Hot/Cold | Cold |

Test results are given in Table 2.

TABLE 2

| Item | Feed Roll Speed mpm | Stretch Roll Speed mpm | In-line Stretch (X) | High-Load Crimp % | Low-Load Crimp % | Tenacity gpd | Denier Filaments |
|---|---|---|---|---|---|---|---|
| 2A | 3201 | 3201 | 1.0 | 2.9 | 23 | 1.7 | 41/13 |
| 2B | 3658 | 3658 | 1.0 | 3.4 | 26 | 1.8 | 41/13 |
| 2C | 4115 | 4115 | 1.0 | 2.5 | 24 | 1.9 | 41/13 |
| 2D | 4572 | 4572 | 1.0 | 3.1 | 23 | 1.8 | 32/13 |
| 2E | 4572 | 4572 | 1.0 | 2.4 | 21 | 1.9 | 20/7 |
| 2F | 3048 | 4572 | 1.5 | 19.1 | 64 | 2.4 | 40/13 |
| 2G | 3048 | 4572 | 1.5 | 19.4 | 64 | 2.5 | 22/7 |

EXAMPLE 3

This example shows that substantial changes in the jet attenuation (JA) factor has little effect on high-load crimp and tenacity. Yarns are prepared as described in Example 1 using the following conditions:

| | |
|---|---|
| Spinneret capillaries (Hi/Lo) mm | Given in Table 3 |
| Melt ratio (Hi/Lo) | 50/50 |
| Nylon types (Hi/Lo) | 66/66 |
| Nylon | |
| RV's (Hi/Lo) | Given in Table 3 |
| RV's Difference | " |
| Feed roll speed (mpm) | 3356 |
| Stretch roll speed (mpm) | 5029 |
| In-line stretch (X) | 1.5 |
| In-line relaxation, Hot/Cold | Hot (9.0%) |

Test results are given in Table 3.

TABLE 3

| Item | Capillary Spinneret Diameter (Hi/Lo) mm | RV's (Hi/Lo) | ΔRV | High-Load Crimp % | Tenacity gpd |
|---|---|---|---|---|---|
| 3A | 0.25/0.25 | 84/43 | 41 | 17.7 | 2.8 |
| 3B | 0.51/0.51 | 82/42 | 40 | 18.3 | 2.7 |

The results given in Table 3 show that increasing the JA by a factor of four gives only a slight increase in high-load crimp.

EXAMPLE 4

This example shows the effect on crimp and tenacity of varying feed roll speeds (spinning speeds) from 1486 to 4572 mpm, stretch roll speeds from 2743 to 5486 mpm and in-line stretch ratios from 1.1 to 1.85. The highest high-load crimp values are obtained at spinning speeds (feed roll speeds) of 2743 mpm and higher and in-line stretch ratios of 1.2 or higher.

In a first series of runs, yarns are prepared as described in Example 1 using the following conditions:

| | |
|---|---|
| Spinneret capillaries (Hi/Lo) mm | 0.51/0.51 |
| Melt ratio (Hi/Lo) | 50/50 |
| Nylon types (Hi/Lo) | 66/66 |
| Nylon | |
| RV's (Hi/Lo) | 66/42 |
| RV's Difference | 24 |
| Feed roll speed (mpm) | Given in Table 4A |
| Stretch roll speed (mpm) | " |
| In-line stretch (X) | " |
| In-line relaxation, Hot/Cold | Cold |

Test results are given in Table 4A.

TABLE 4A

| Item | Feed Roll Speed mpm | Stretch Roll Speed mpm | In-line Stretch (X) | High-Load Crimp % | Tenacity gpd |
|---|---|---|---|---|---|
| 4AA | 2195 | 2743 | 1.25 | 5.3 | 2.7 |
| 4AB | 1829 | 2743 | 1.5 | 3.7 | 3.4 |
| 4AC | 1715 | 2743 | 1.6 | 3.7 | 3.5 |
| 4AD | 1481 | 2743 | 1.85 | 3.9 | 3.8 |

In a second series of runs, yarns are prepared as described in Example 1 using the following conditions:

| | |
|---|---|
| Spinneret capillaries (Hi/Lo) mm | 0.51/0.51 |
| Melt ratio (Hi/Lo) | 50/50 |
| Nylon types (Hi/Lo) | 66/66 |
| Nylon | |
| RV's (Hi/Lo) | 60/48 |
| RV's Difference | 12 |
| Feed roll speed (mpm) | Given in Table 4B |
| Stretch roll speed (mpm) | " |
| In-line stretch (X) | " |
| In-line relaxation, Hot/Cold | Cold |

Test results are given in Table 4B.

TABLE 4B

| Item | Feed Roll Speed mpm | Stretch Roll Speed mpm | In-line Stretch (X) | High-Load Crimp % | Tenacity gpd |
|---|---|---|---|---|---|
| 4BA | 2494 | 2743 | 1.1 | 3.6 | 2.1 |
| 4BB | 2286 | 2743 | 1.2 | 7.9 | 2.1 |
| 4BC | 2110 | 2743 | 1.3 | 10.5 | 2.2 |
| 4BD | 1960 | 2743 | 1.4 | 11.5 | 2.8 |
| 4BE | 1829 | 2743 | 1.5 | 8.9 | 2.6 |
| 4BF | 2910 | 3201 | 1.1 | 5.3 | 2.1 |
| 4BG | 2667 | 3201 | 1.2 | 12.1 | 2.3 |
| 4BH | 2462 | 3201 | 1.3 | 14.4 | 2.3 |
| 4BI | 2286 | 3201 | 1.4 | 14.7 | 2.6 |
| 4BJ | 2133 | 3201 | 1.5 | 14.2 | 2.6 |
| 4BK | 3325 | 3658 | 1.1 | 5.4 | 2.2 |
| 4BL | 3048 | 3658 | 1.2 | 12.3 | 2.3 |
| 4BM | 2814 | 3658 | 1.3 | 16.4 | 2.3 |
| 4BN | 2613 | 3658 | 1.4 | 15.3 | 2.6 |
| 4BO | 2439 | 3658 | 1.5 | 11.0 | 2.8 |
| 4BP | 3741 | 4115 | 1.1 | 6.7 | 2.3 |
| 4BQ | 3429 | 4115 | 1.2 | 12.5 | 2.3 |
| 4BR | 3166 | 4115 | 1.3 | 15.3 | 2.4 |
| 4BS | 2939 | 4115 | 1.4 | 16.4 | 2.6 |
| 4BT | 2743 | 4115 | 1.5 | 15.7 | 2.7 |

In a third series of runs yarns are prepared as in Series 4B except the melt ratio is different and the RV difference between the polymers is much higher. The following conditions are used:

| | |
|---|---|
| Spinneret capillaries (Hi/Lo) mm | 0.51/0.51 |
| Melt ratio (Hi/Lo) | 40/60 |
| Nylon types (Hi/Lo) | 66/66 |

-continued

| | |
|---|---|
| Nylon | |
| RV's (Hi/Lo) | 70/42 |
| RV's Difference | 28 |
| Feed roll speed (mpm) | Given in Table 4C |
| Stretch roll speed (mpm) | " |
| In-line stretch (X) | " |
| In-relaxation, Hot/Cold | Cold |

Test results are given in Table 4C.

TABLE 4C

| Item | Feed Roll Speed mnm | Stretch Roll Speed mpm | In-line Stretch (X) | High-Load Crimp % | Tenacity gpd |
|---|---|---|---|---|---|
| 4CA | 3429 | 4115 | 1.20 | 14.9 | 1.8 |
| 4CB | 3292 | 4115 | 1.25 | 16.5 | 1.9 |
| 4CC | 3166 | 4115 | 1.30 | 19.4 | 1.9 |
| 4CD | 3048 | 4115 | 1.35 | 19.8 | 1.9 |
| 4CE | 2940 | 4115 | 1.40 | 21.3 | 2.1 |
| 4CF | 3809 | 4572 | 1.20 | 15.2 | 1.9 |
| 4CG | 3658 | 4572 | 1.25 | 18.0 | 2.0 |
| 4CH | 3516 | 4572 | 1.30 | 19.2 | 1.9 |
| 4CI | 3383 | 4572 | 1.35 | 21.8 | 2.0 |
| 4CJ | 3264 | 4572 | 1.40 | 22.5 | 2.1 |
| 4CK | 3155 | 4572 | 1.45 | 24.1 | 2.1 |
| 4CL | 3048 | 4572 | 1.50 | 23.4 | 2.2 |

In a fourth series of runs yarns are prepared as in series 4C using the following conditions:

| | |
|---|---|
| Spinneret capillaries (Hi/Lo) mm | 0.51/0.51 |
| Melt ratio (Hi/Lo) | 50/50 |
| Nylon types (Hi/Lo) | 66/66 |
| Nylon | |
| RV's (Hi/Lo) | 63/36 |
| RV's Difference | 27 |
| Feed roll speed (mpm) | Given In Table 4D |
| Stretch roll speed (mpm) | " |
| In-line stretch (X) | " |
| In-line relaxation, Hot/Cold | Cold |

Test results are given in Table 4D.

TABLE 4D

| Item | Feed Roll Speed mpm | Stretch Roll Speed mpm | In-line Stretch (X) | High-Load Crimp % | Low-Load Crimp % | Tenacity gpd |
|---|---|---|---|---|---|---|
| 4DA | 4156 | 4572 | 1.1 | 4.9 | 34 | 2.4 |
| 4BD | 3810 | 4572 | 1.2 | 12.8 | 57 | 2.5 |
| 4DC | 3517 | 4572 | 1.3 | 18.0 | 63 | 2.5 |
| 4DD | 3265 | 4572 | 1.4 | 19.2 | 66 | 2.7 |
| 4DE | 3048 | 4572 | 1.5 | 19.7 | 68 | 2.7 |
| 4DF | 2858 | 4572 | 1.6 | 17.6 | 67 | 2.9 |
| 4DG | 4572 | 5029 | 1.1 | 3.9 | 41 | 2.2 |
| 4DH | 4191 | 5029 | 1.2 | 11.7 | 58 | 2.5 |
| 4DI | 3869 | 5029 | 1.3 | 17.5 | 64 | 2.7 |
| 4DJ | 3593 | 5029 | 1.4 | 19.9 | 67 | 2.8 |
| 4DK | 3353 | 5029 | 1.5 | 19.5 | 67 | 2.8 |
| 4DL | 3144 | 5029 | 1.6 | 19.4 | 68 | 3.0 |

In a fifth series of runs, yarns are prepared as in series 4D except the melt ratio is different. The following conditions are used:

| | |
|---|---|
| Spinneret capillaries (Hi/Lo) mm | 0.41/0.51 |
| Melt ratio (Hi/Lo) | 40/60 |
| Nylon types (Hi/Lo) | 66/66 |
| Nylon | |
| RV's (Hi/Lo) | 72/41 |
| RV's Difference | 31 |
| Feed roll speed (mpm) | Given in Table 4E |

-continued

| | |
|---|---|
| Stretch roll speed (mpm) | " |
| In-line stretch (X) | " |
| In-line relaxation, Hot/Cold | Cold |

Test results are given in Table 4E.

TABLE 4E

| Item | Feed Roll Speed mpm | Stretch Roll Speed mpm | In-line Stretch (X) | High-Load Crimp % | Tenacity gpd |
|---|---|---|---|---|---|
| 4EA | 3870 | 4572 | 1.20 | 15.3 | 1.9 |
| 4EB | 3516 | 4572 | 1.30 | 20.0 | 2.0 |
| 4EC | 3388 | 4572 | 1.35 | 22.7 | 2.2 |
| 4ED | 3266 | 4572 | 1.40 | 22.1 | 2.2 |
| 4EE | 3155 | 4572 | 1.45 | 21.4 | 2.3 |
| 4EF | 3048 | 4572 | 1.50 | 21.2 | 2.6 |
| 4EG | 2950 | 4572 | 1.55 | 21.9 | 2.5 |
| 4EH | 2858 | 4572 | 1.60 | 21.4 | 2.4 |
| 4EI | 3726 | 5029 | 1.35 | 21.5 | 2.2 |
| 4EJ | 3594 | 5029 | 1.40 | 22.3 | 2.4 |
| 4EL | 3354 | 5029 | 1.50 | 22.3 | 2.5 |
| 4EM | 3244 | 5029 | 1.55 | 21.8 | 2.7 |
| 4EN | 3146 | 5029 | 1.60 | 20.7 | 2.7 |

In a sixth series of runs, yarns are prepared as in series 4D except a stretch roll speed of 5486 mpm is used. The conditions used are:

| | |
|---|---|
| Spinneret capillaries (Hi/Lo) mm | 0.25/0.25 |
| Melt ratio (Hi/Lo) | 50/50 |
| Nylon types (Hi/Lo) | 66/66 |
| Nylon | |
| RV's (Hi/Lo) | 75/41 |
| RV's Difference | 34 |
| Feed roll speed (mpm) | Given in Table 4F |
| Stretch roll speed (mpm) | " |
| In-line stretch (X) | " |
| In-line relaxation, Hot/Cold | Hot (8.0%) |

Test results are given in Table 4F.

TABLE 4F

| Item | Feed Roll Speed mpm | Stretch Roll Speed mpm | In-line Stretch (X) | High-Load Crimp % | Tenacity gpd |
|---|---|---|---|---|---|
| 4FA | 3786 | 5486 | 1.45 | 17.6 | 3.2 |
| 4FB | 3658 | 5486 | 1.50 | 17.0 | 3.3 |
| 4FC | 3543 | 5486 | 1.55 | 16.1 | 3.3 |
| 4FD | 3429 | 5486 | 1.60 | 15.5 | 3.4 |
| 4FE | 3328 | 5486 | 1.65 | 15.2 | 3.6 |

EXAMPLE 5

This example shows the effect of varying the RV in the 24 to 34 range. Yarns are prepared as in Example 1 using the following conditions:

| | |
|---|---|
| Spinneret capillaries (Hi/Lo) mm | 0.25/0.25 |
| Melt ratio (Hi/Lo) | 50/50 |
| Nylon types (Hi/Lo) | 66/66 |
| Nylon | |
| RV's (Hi/Lo) | Given in Table 5 |
| RV's Differerce | " |
| Feed roll speed (mpm) | 3048 |
| Stretch roll speed (mpm) | 4572 |
| In-line stretch (X) | 1.5 |
| In-line relaxation, Hot/Cold | Cold (6.3%) |

Test results are given in Table 5.

TABLE 5

| Item | RV's (Hi/Lo) | ΔRV | High-Load Crimp % | Low-Load Crimp % | BWS % |
|---|---|---|---|---|---|
| 5A | 62/38 | 24 | 15.1 | 60 | 5.3 |
| 5B | 72/38 | 34 | 18.0 | 65 | 5.1 |
| 5C | 75/46 | 29 | 17.1 | 65 | 5.0 |
| 5D | 54/22 | 32 | 18.0 | — | — |

The results in Table 5 show that in general increasing the ΔRV increases high-load crimp.

EXAMPLE 6

In this example yarns are prepared as in Example 5. In this instance the RV of the high RV polyamide is varied while the RV of the Low RV polyamide is held constant. The conditions used are:

| | |
|---|---|
| Spinneret capillaries (Hi/Lo) mm | 0.51/0.51 |
| Melt ratio (Hi/Lo) | 40/60 |
| Nylon types (Hi/Lo) | 66/66 |
| Nylon | |
| RV's (Hi/Lo) | Given in Table 6 |
| RV's Difference | " |
| Feed roll speed (mpm) | 3155 |
| Stretch roll speed (mpm) | 4572 |
| In-line stretch (X) | 1.45 |
| In-line relaxation, Hot/Cold | Hot |

Test results are given in Table 6.

TABLE 6

| Item | RV's (Hi/Lo) | ΔRV | High-Load Crimp % | Low-Load Crimp % |
|---|---|---|---|---|
| 6A | 67/49 | 18 | 16.5 | 65 |
| 6B | 90/49 | 41 | 24.9 | 72 |

As in Example 5, the results show that high-load crimp increases with increases in ΔRV.

EXAMPLE 7

This example shows the effect of varying the melt ratio on high-load crimp and low-load crimp. The yarns are prepared as in Example 6 using the following conditions:

| | |
|---|---|
| Spinneret capillaries (Hi/Lo) mm | 0.23/0.23 |
| Melt ratio (Hi/Lo) | Given in Table 7 |
| Nylon types (Hi/Lo) | 66/66 |
| Nylon | |
| RV's (Hi/Lo) | 62/39 |
| RV's Difference | 23 |
| Feed roll speed (mpm) | 2857 |
| Stretch roll speed (mpm) | 4115 |
| In-line stretch (X) | 1.4 |
| In-line relaxation, Hot/Cold | Cold |

Test results are givn in Table 7.

TABLE 7

| Item | Melt Ratio (Hi/Lo) | High-Load Crimp % | Low-Load Crimp % |
|---|---|---|---|
| 7A | 65/35 | 8.3 | 54 |
| 7B | 63/37 | 9.6 | 58 |
| 7C | 60/40 | 10.5 | 59 |
| 7D | 58/42 | 12.0 | 60 |

TABLE 7-continued

| Item | Melt Ratio (Hi/Lo) | High-Load Crimp % | Low-Load Crimp % |
|---|---|---|---|
| 7E | 55/45 | 13.5 | 62 |
| 7F | 53/47 | 14.3 | 64 |
| 7G | 50/50 | 15.0 | 64 |
| 7H | 50/50 | 15.2 | 62 |
| 7I | 47/53 | 16.8 | 64 |
| 7J | 45/55 | 17.9 | 66 |
| 7K | 42/58 | 18.0 | 67 |
| 7L | 40/60 | 18.8 | 69 |

The results show that changing the melt ratio has a significant effect on high-load crimp and relatively little effect on low-load crimp.

EXAMPLE 8

This example illustrates the effects of steam conditioning the yarn on crimp. Yarns are prepared as in Example 1 except that the filaments are passed through a tube (steam conditioning tube) having a diameter of 12.7 cm and a length of 182.9 cm. The tube is placed 132 cm from the face of the spinneret. Steam is introduced into the tube through ports located near the filament inlet end of the tube. The following conditions are used:

| | |
|---|---|
| Spinneret capillaries (Hi/Lo) mm | 0.41/0.51 |
| Melt ratio (Hi/Lo) | 50/50 |
| Nylon types (Hi/Lo) | 66/66 |
| Nylon | |
| RV's (Hi/Lo) | 89/44 |
| RV's Difference | 45 |
| Feed roll speed (mpm) | 2858 |
| Stretch roll speed (mpm) | 4572 |
| In-line stretch (X) | 1.6 |
| In-line relaxation, Hot/Cold | Cold (7.1%) |

Test results are given in Table 8.

TABLE 8

| Item | Tube Fluid | High-Load Crimp % | Low-Load Crimp % | BWS % |
|---|---|---|---|---|
| 8A | Ambient Air | 21.3 | 72 | 6.4 |
| 8B | Steam, 136 kN/m$^2$ | 3.3 | 42 | 8.5 |
| 8C | Steam, 153 kN/m$^2$ | 2.0 | 24 | 8.8 |
| 8D | Steam, 205 kN/m$^2$ | 2.1 | 27 | 8.9 |

The negative effects of steam conditioning on high-load crimp is dramatically shown in Table 8.

EXAMPLE 9

This example illustrates the use of spinnerets constructed in such a way that the polymer streams converge at a point other than below the spinneret face.

In one series of runs, two yarns of different denier (9AA and 9AB) are prepared as in Example 1 except in this instance a spinneret is used in which the two angled capillaries (polymer streams) join at the spinneret face rather than below the spinneret face as shown in FIG. 1. The following conditions are used:

| | |
|---|---|
| Spinneret capillaries (Hi/Lo) mm | 0.25/0.25 |
| Melt ratio (Hi/Lo) | 50/50 |
| Nylon types (Hi/Lo) | 66/66 |
| Nylon | |
| RV's (Hi/Lo) | 61/47 |
| RV's Difference | 14 |
| Feed roll speed (mpm) | 2939 |
| Stretch roll speed (mpm) | 4115 |
| In-line stretch (X) | 1.4 |
| In-line relaxation, Hot/Cold | Cold |

Test results are given in Table 9A.

TABLE 9A

| Item | Denier/ Fils. | High-Load Crimp % | Low-Load Crimp % | Tenacity gpd |
|---|---|---|---|---|
| 9AA | 20/7 | 14.5 | 69 | 3.0 |
| 9AB | 40/13 | 13.9 | 68 | 2.8 |

In another series of runs, two yarns (9BA and 9BB) are prepared as above except that in this instance each filament is formed by combining the polymer streams above the spinneret face and then extruding the combined streams through a common capillary of the spinneret. Also, the nylon 66's have a ΔRV of 28 instead of 14. The following conditions are used:

| | |
|---|---|
| Spinneret capillaries (mm) | 0.51 |
| Melt ratio (Hi/Lo) | 50/50 |
| Nylon types (Hi/Lo) | 66/66 |
| Nylon | |
| RV's (Hi/Lo) | 69/41 |
| RV's Difference | 28 |
| Feed roll speed (mpm) | 3048 |
| Stretch roll speed (mpm) | 4572 |
| In-line stretch (X) | 1.5 |
| In-line relaxation, Hot/Cold | Cold |

Test results are given in Table 9B.

TABLE 9B

| Item | Denier/ Fils. | High-Load Crimp % | Low-Load Crimp % | Tenacity gpd |
|---|---|---|---|---|
| 9BA | 22/7 | 22.3 | 76 | 2.7 |
| 9BB | 40/13 | 15.6 | 73 | 2.9 |

The results given in Tables 9A and 9B show that spinneret constructions other than those where the polymers converge below the spinneret may effectively be used in practicing the present invention.

A comparison of the crimp values in Table 9B with those in Table 9A shows that in this instance increasing the ΔRV results in an increase in crimp values.

EXAMPLE 10

This example illustrates the preparation of yarns in accordance with the invention wherein the high viscosity and/or low viscosity polyamide is a polyamide other than nylon 66.

In one series of runs, yarns are made from nylon 610 and nylon 66 using the following conditions:

| | |
|---|---|
| Spinneret capillaries (Hi/Lo) mm | 0.25/0.25 |
| Melt ratio (Hi/Lo) | 50/50 |
| Nylon types (Hi/Lo) | 610/66 |
| Nylon | |
| RV's (Hi/Lo) | Given in Table 10 |
| RV's Difference | " |
| Feed roll speed (mpm) | 2858 |

-continued

| | |
|---|---|
| Stretch roll speed (mpm) | 4572 |
| In-line stretch (X) | 1.6 |
| In-line relaxation, Hot/Cold | Cold |

Test results are given in Table 10A.

TABLE 10A

| Item | RV's (Hi/Lo) | ΔRV | High-Load Crimp % | Low-Load Crimp % | BWS % |
|---|---|---|---|---|---|
| 10AA | 63/48 | 15 | 17.4 | 64 | 7.2 |
| 10AB | 56/48 | 8 | 9.8 | 50 | 6.3 |

The results in Table 10A show that acceptable crimp values are obtained using nylon 610 in combination with nylon 66 (Item 10AA). The results also show the importance of the ΔRV. Note that in run 10AB the RV is not of a sufficient magnitude to obtain a significant high-load value.

In another series of runs, yarns are made from nylon 66 and nylon 6 using the following conditions:

| | |
|---|---|
| Spinneret capillaries (Hi/Lo) mm | 0.51/0.51 |
| Melt ratio (Hi/Lo) | Given in Table 10B |
| Nylon types (Hi/Lo) | 66/66 |
| Nylon | |
| RV's (Hi/Lo) | Given in Table 10B |
| RV's Difference | " |
| Feed roll speed (mpm) | " |
| Stretch roll speed (mpm) | 4572 |
| In-line stretch (X) | Given in Table 10B |
| In-line relaxation, Hot/Cold | Cold |

Test results are given in Table 10B.

TABLE 10B

| Item | RV's Hi/Lo | ΔRV | Melt Ratio | Feed Roll Speed mpm | In-line Stretch X | High-Load Crimp % | Low-Load Crimp % |
|---|---|---|---|---|---|---|---|
| 10BA | 67/38 | 29 | 40/60 | 3048 | 1.5 | 19.9 | 68 |
| 10BB | 67/38 | 29 | 50/50 | 3048 | 1.5 | 12.9 | 63 |
| 10BC | 78/36 | 42 | 50/50 | 2858 | 1.6 | 16.6 | 63 |

In another series of runs, yarns are made from nylon 6 using the following conditions:

| | |
|---|---|
| Spinneret capillaries (Hi/Lo) mm | 0.51/0.51 |
| Melt ratio (Hi/Lo) | Given in Table 10C |
| Nylon types (Hi/Lo) | 6/6 |
| Nylon | |
| RV's (Hi/Lo) | 57/38 |
| RV's Difference | 19 |
| Feed roll speed (mpm) | 3048 |
| Stretch roll speed (mpm) | 4572 |
| In-line stretch (X) | 1.5 |
| In-line relaxation, Hot/Cold | Cold |

Test results are given in Table 10C.

TABLE 10C

| Item | Melt Ratio | High-Load Crimp % | Low-Load Crimp % |
|---|---|---|---|
| 10CA | 50/50 | 14.6 | 62 |
| 10CB | 40/60 | 16.9 | 64 |

In another series of runs, yarns are made from nylon 66 and a nylon 66-612 (50:50) copolymer using the following conditions:

| | |
|---|---|
| Spinneret capillaries (Hi/Lo) mm | 0.51/0.51 |
| Melt ratio (Hi/Lo) | Given in Table 10D |
| Nylon types (Hi/Lo) | 66/66-612 (50:50) |
| Nylon | |
| RV's (Hi/Lo) | 78/36 |
| RV's Difference | 42 |
| Feed roll speed (mpm) | 2858 |
| Stretch roll speed (mpm) | 4572 |
| In-line stretch (X) | 1.6 |
| In-line relaxation, Hot/Cold | Cold |

Test results are given in Table 10D.

TABLE 10D

| Item | Melt Ratio | High-Load Crimp % | Low-Load Crimp % | BWS % |
|---|---|---|---|---|
| 10DA | 50/50 | 12.8 | 59 | 10.6 |
| 10DB | 40/60 | 15.3 | 62 | 10.3 |

In another series of runs, yarns are prepared under the same conditions employed in Series 10D except in this instance the copolymer is the high RV polymer and the homopolymer is the low RV polymer. The following conditions are used:

| | |
|---|---|
| Spinneret capillaries (Hi/Lo) mm | 0.25/0.25 |
| Melt ratio (Hi/Lo) | 50/50 |
| Nylon types (Hi/Lo) | 66-610 (50:50)/66 |
| Nylon | |
| RV's (Hi/Lo) | Given in Table 10E |
| RV's Difference | " |
| Feed roll speed (mpm) | 2858 |
| Stretch roll speed (mpm) | 4572 |
| In-line stretch (X) | 1.6 |
| In-line relaxation, Hot/Cold | Cold |

Test results are given in Table 10E.

TABLE 10E

| Item | RV's (Hi/Lo) | ΔRV | High-Load Crimp % | Low-Load Crimp % | BWS % | CRIMP/BWS |
|---|---|---|---|---|---|---|
| 10EA | 72/46 | 26 | 11.7 | 54 | 20.4 | 0.57 |
| 10EB | 82/49 | 33 | 13.5 | 55 | 18.2 | 0.74 |

The results shown in Table 10E show the adverse effects on BWS values when the copolyamide is used as the high RV component.

In another series of runs, yarns are prepared under the same conditions employed in Series 10E except in this instance the polyamides are:

| | |
|---|---|
| nylon types (Hi/Lo) | 6-66 (15:85)/66 |
| nylon RV's (Hi/Lo) | Given in Table 10F |

Test results are given in Table 10F.

TABLE 10F

| Item | RV's (Hi/Lo) | ΔRV | High-Load Crimp % | Low-Load Crimp % | BWS % |
|---|---|---|---|---|---|
| 10FA | 93/48 | 45 | 18.9 | 64 | 7.7 |

TABLE 10F-continued

| Item | RV's (Hi/Lo) | ΔRV | High-Load Crimp % | Low-Load Crimp % | BWS % |
|---|---|---|---|---|---|
| 10FB | 68/48 | 20 | 12.5 | 50 | 8.1 |

EXAMPLE 11

In this example various as-spun conjugate yarns were prepared at low spinning speeds using the equipment described in Example 1 and conditions given in Table 11A. The yarns were steam conditioned before being wound onto the bobbin. The as-spun yarns are lagged at ambient conditions and then subsequently stretched in a separate operation between stretch rolls under conditions given in Table 11B. Test results are also given in Table 11B.

TABLE 11A

| Yarn | Polymers (Hi/Lo) | RV's (Hi/Lo) | ΔRV | Feed Roll Speed mpm | Stretch Roll Speed mpm | Stretch |
|---|---|---|---|---|---|---|
| A | 66-610*/66 | 65/55 | 10 | 640 | 640 | None |
| B | 66/66 | 79/55 | 24 | 640 | 640 | None |
| C | 66/6-66** | 45/36 | 9 | 474 | 474 | None |

*50:50
**15:85

TABLE 11B

| Yarn | Stretch (X) | Stretch Temp. °C. | High-Load Crimp % | BWS % |
|---|---|---|---|---|
| A | 4 | 112 | 0.8 | 15.3 |
| A | 4 | 55 | 6.6 | 30.5 |
| A | 4 | Ambient* | 6.4 | 30.9 |
| B | 4 | 112 | 0.8 | 11.1 |
| B | 4 | 55 | 0.8 | 12.2 |
| B | 4 | Ambient* | 0.8 | 12.2 |
| C | 2.5 | Ambient | 0.8 | 13.0 |
| C | 4.0 | Ambient | 0.9 | 12.9 |

*Over a cold pin

The results in Table 11B show that when the yarn is spun at low speeds and then stretched in a subsequent operation, the yarn does not have significant high-load crimp.

EXAMPLE 12

This example demonstrates the effect on high-load crimp of using an aqueous finish (Aq) versus an anhydrous finish (Anhy) in instances where the stretching of the filaments is an in-line stretch versus a post stretch in a separate operation.

A series of yarns are prepared as in Example 1 using the following conditions:

| | |
|---|---|
| Spinneret capillaries (Hi/Lo) mm | 0.25/0.25 |
| Melt ratio (Hi/Lo) | 50/50 |
| Nylon types (Hi/Lo) | 66/66 |
| Nylon | |
| RV's (Hi/Lo) | Given in Table 12 |
| RV's Difference | " |
| Feed Roll speed (mpm) | " |
| Stretch roll speed (mpm) | " |
| In-line stretch (X) | " |
| In-line relaxation, Hot/Cold | Cold |

Test results are given in Table 12.

TABLE 12

| Item | Fin. Type | RV's (Hi/Lo) | Feed Roll Speed mpm | Str. Roll Speed mpm | In-Ln. Stretch (X) | Post Stretch (X) | High-Load Crimp % | Low-Load Crimp % |
|---|---|---|---|---|---|---|---|---|
| 12A | Anhy | 69/49 | 2858 | 4572 | 1.6 | — | 17.2 | 64 |
| 12B | Aq | 69/49 | 2858 | 4572 | 1.6 | — | 19.2 | 66 |
| 12C | Anhy | 69/49 | 2858 | 2858 | 1.0 | 1.6* | 9.4 | 50 |
| 12D | Aq | 69/49 | 2858 | 2858 | 1.0 | 1.6* | 3.3 | 27 |
| 12E | Anhy | 77/47 | 2858 | 4572 | 1.6 | — | 16.7 | 66 |
| 12F | Aq | 77/47 | 2858 | 4572 | 1.6 | — | 16.2 | 67 |
| 12G | Anhy | 77/47 | 2858 | 2858 | 1.0 | 1.6** | 11.6 | 60 |
| 12H | Aq | 77/47 | 2858 | 2858 | 1.0 | 1.6** | 2.5 | 30 |
| 12I | Anhy | 77/47 | 2858 | 2858 | 1.0 | 1.6*** | 9.0 | 45 |
| 12J | Aq | 77/47 | 2858 | 2858 | 1.0 | 1.6*** | 2.3 | 21 |

*As-spun yarns are collected and sealed in small plastic bags until post stretched 3¼ hrs. later.
**Same as * except post stretch ⅞ hr. after collection of as-spun yarns instead of 3¼ hours.
*Same as  except post stretched 24 hours after collection.
Post stretching is done between two pairs of rotating rolls, a first pair rotating at a peripheral speed of 2858 mpm and a second pair rotating at a peripheral speed of 4572 mpm.

The results in Table 12 show that considerable high-load crimp is lost if the yarn is lagged before stretching. Compare items 12A and B to 12C and D and 12E and F to 12G through J. The results also show that moisture has an adverse effect on the power crimp of lagged yarn (compare 12C to 12D) and worsens with time (compare 12D to 12H to 12J).

In the foregoing examples the importance of selecting and correlating processing conditions and of selecting polymers with respect to melt viscosities, melt viscosity differences, polymer type, etc. on high-load crimp values is demonstrated.

EXAMPLE 13

In this example five polyamide conjugate yarns of the present invention are compared to two commercially available polyamide conjugate hoisery yarns (controls) with respect to the ability of the yarns to develop useful crimp for hoisery applications when exposed to 120° C. hot air (high-load crimp), when immersed in boiling water (boiling water crimp), when immersed in room temperature water which is then gradually brought to the boil (simulation of conventional atmospheric pressure dyeing i.e., dye bath crimp) and when immersed in room temperature (cold) water with no heating (cold water crimp) and with respect to the shrinkages of the yarns when the yarns are exposed to the above crimping conditions.

The yarns of the present invention used for making the comparison were prepared using the equipment described in Example 1. The conditions used in preparing each of the five yarns are given below in Table 13A.

TABLE 13A

| Yarn Sample | 13A | 13B | 13C | 13D | 13E |
|---|---|---|---|---|---|
| Spinneret capillaries (Hi/Lo) mm | 0.41/0.51 | 0.41/0.51 | 0.41/0.51 | 0.41/0.51 | 0.41/0.51 |
| Melt ratio (Hi/Lo) | 50/50 | 40/60 | 50/50 | 60/40 | 50 |
| Nylon types (Hi/Lo) | 66/66 | 66-610[1]/66 | 66-610/66 | 66-610/66 | 6-66[2]/66 |
| Nylon | | | | | |
| RV's (Hi/Lo) | 79/47 | 104/45 | 104/45 | 104/45 | 155/48 |
| ΔRV | 32 | 59 | 59 | 59 | 107 |
| Feed Roll Speed (mpm) | 3353 | 3046 | 3046 | 3046 | 3353 |
| Stretch Roll Speed (mpm) | 5029 | 4572 | 4572 | 4572 | 5029 |
| In-Line Stretch (X) | 1.5 | 1.5 | 1.5 | 1.5 | 1.5 |
| In-Line Relaxation (Hot/Cold) | none | none | none | none | none |

[1]a copolymer consisting of 50% by weight of 66 and 50% by weight of 610.
[2]a copolymer consisting of 15% by weight of 6 and 85% by weight of 66.

The two commercially obtained yarns had the following composition:

TABLE 13B

| Yarn Sample | 13F | 13G |
|---|---|---|
| Melt ratio (Hi/Lo) | 60/40 | 60/40 |
| Nylon type (Hi/Lo) | 66-610-612[1]/66 | 6-612[2]/612 |

[1]a terpolymer consisting of 53% by weight of 66, 30% by weight of 610 and 17% by weight of 612.
[2]a copolymer consisting of 37% by weight of 6 and 63% by weight of 612.

Crimp test results obtained for each of the yarns is given below in Table 13C.

TABLE 13C

| Yarn | High-Load Crimp, % | Dye Bath Crimp, % | Boiling $H_2O$ Crimp, % | Cold $H_2O$ Crimp, % |
|---|---|---|---|---|
| 13A | 21.4 | 37.7 | 35.4 | 48.1 |
| 13B | 20.1 | 36.8 | 54.6 | 48.0 |
| 13C | 18.0 | 34.8 | 53.9 | 39.0 |
| 13D | 15.9 | 32.2 | 54.1 | 34.9 |
| 13E | 18.4 | 36.1 | 46.0 | 47.1 |
| 13F (control) | 5.6 | 14.5 | 25.8 | 8.2 |
| 13G (control) | 1.4 | 13.7 | 28.4 | 1.6 |

The results given in Table 13C clearly show that filaments of the present invention have the ability to develop a useful level hoisery-typecrimp under mild conditions, whereas, the prior art control yarns do not have this ability. This means that the filaments of the present invention have the ability to develop a useful hoisery-type crimp when subjected to 120° C. hot-air or a conventional atmospheric pressure dye bath, whereas prior art filaments require much more drastic conditions, for example, treatment with 118° C. superheated steam.

Shrinkage test results obtained for each of the yarns is given below in Table 13D.

TABLE 13D

| Yarn | High-Load Shrinkage, % | Dye Bath Shrinkage, % | Boiling $H^2O$ Shrinkage, % | Cold $H^2O$ Shrinkage, % |
|---|---|---|---|---|
| 13A | 5.2 | 4.2 | 6.0 | 1.1 |
| 13B | 5.2 | 3.7 | 9.7 | 8.8 |
| 13C | 6.1 | 4.1 | 12.1 | 7.1 |
| 13D | 6.3 | 4.8 | 16.0 | 7.1 |
| 13E | 6.1 | 6.3 | 7.4 | 3.0 |
| 13F (control) | 5.2 | 5.5 | 7.6 | 2.1 |

TABLE 13D-continued

| Yarn | High-Load Shrinkage, % | Dye Bath Shrinkage, % | Boiling $H^2O$ Shrinkage, % | Cold $H^2O$ Shrinkage, % |
|---|---|---|---|---|
| 13G (control) | 5.0 | 5.1 | 7.2 | 0.2 |

The results given in Table 13D show that each of the yarns have acceptable high-load and dye bath shrinkage values for hoisery applications. In the case of the yarns of the present invention (Yarns 13A–13E) the ratio of CRIMP/DBS is at least 3.0 and in the case of Yarns 13A and 13B is greater than 5.0.

What is claimed is:

1. A substantially torque-free filament comprising a first longitudinal polyamide segment and a second longitudinal polyamide segment arranged in a side-by-side configuration along the length of the filament and differing from each other in longitudinal dimensional change characteristics, said filament having a high-load crimp test value of at least 12% and a boiling water shrinkage test value such that the quotient obtained by dividing said crimp test value by said shrinkage test value is at least one.

2. The filament of claim 1 wherein the volume ratio of the segments is in the range of 3:1 to 1:3.

3. The filament of claim 1 wherein said quotient is at least 2.

4. The filament of claim 4 wherein said crimp test value is at least 15%.

5. The filament of claim 1 wherein said quotient is at least 3.

6. The filament of claim 6 wherein said crimp test value is at least 18%.

7. The filament of claim 1 wherein one of said segments consists essentially of a homopolyamide rand the other segment consists essentially of a copolyamide.

8. The filament of claim 7 wherein said homopolyamide is nylon 66.

9. The filament of claim 7 wherein said homopolyamide is nylon 6.

10. A substantially torque-free filament consisting essentially of two longitudinal segments arranged in an side-by-side configuration along the length of the filament and differing from each other in longitudinal dimensional change characteristics, wherein each segment consists essentially of nylon 6 or nylon 66 and said filament has a high-load crimp test value of at least 12% and a boiling water shrinkage test value such that the quotient obtained by dividing said crimp test value by said shrinkage test value is at least one.

11. The filament of claim 10 wherein one segment consists essentially of nylon 66 and the other segment consists essentially of nylon 6.

12. The filament of claim 10 wherein both segments consist essentially of nylon 6.

13. The filament of claim 10 wherein both segments consist essentially of nylon 66.

14. The filament of claim 13 wherein said quotient is at least 3.

15. The filament of claim 14 wherein said crimp test value is at least 18%.

16. The filament of claim 15 wherein said crimp test value is at least 20%.

17. Filaments of claim 1 in the form of a yarn.

18. Filaments of claim 10 in the form of a yarn.

* * * * *